US010760743B2

(12) United States Patent
Yang

(10) Patent No.: US 10,760,743 B2
(45) Date of Patent: Sep. 1, 2020

(54) LAMP

(71) Applicant: Shanghai blue lake lighting tech. co., Ltd., Shanghai (CN)

(72) Inventor: Yi Yang, Shanghai (CN)

(73) Assignee: SHANGHAI BLUE LAKE LIGHTING TECH. CO., LTD., Shanghai (CN)

( * ) Notice: Subject to any disclaimer, the term of this patent is extended or adjusted under 35 U.S.C. 154(b) by 0 days.

(21) Appl. No.: 16/621,642

(22) PCT Filed: Jun. 1, 2018

(86) PCT No.: PCT/CN2018/089581
§ 371 (c)(1),
(2) Date: Dec. 11, 2019

(87) PCT Pub. No.: WO2018/228222
PCT Pub. Date: Dec. 20, 2018

(65) Prior Publication Data

US 2020/0208787 A1 Jul. 2, 2020

(30) Foreign Application Priority Data

Jun. 14, 2017 (CN) ..... 2017 1 0449020

(51) Int. Cl.
*F21S 41/675* (2018.01)
*F21K 9/20* (2016.01)
(Continued)

(52) U.S. Cl.
CPC ..... *F21K 9/20* (2016.08); *F21V 7/0083* (2013.01); *F21V 13/14* (2013.01); *F21Y 2115/30* (2016.08)

(58) Field of Classification Search
None
See application file for complete search history.

(56) References Cited

U.S. PATENT DOCUMENTS

2013/0314893 A1 11/2013 Paquette
2014/0168940 A1* 6/2014 Shiomi ..... F21V 9/08 362/84

(Continued)

FOREIGN PATENT DOCUMENTS

CN 102620244 A 8/2012
CN 204694981 U 10/2015

(Continued)

*Primary Examiner* — Elmito Breval
(74) *Attorney, Agent, or Firm* — Blue Filament Law PLLC

(57) ABSTRACT

A lamp is provided that includes a light source (119), having a laser diode (111, 511, 911) and a fluorescent sheet (112). The laser (121, 521, 621, 721, 921) emitted from the laser diode (111, 511, 911) is focused on the fluorescent sheet (112) and excites the fluorescent sheet (112) to emit fluorescent light (123, 323). The fluorescent sheet (112) has a transparent thermally conductive substrate (512*a*, 612*a*, 712*a*, 912*a*, 1012*a*) and a fluorescent coating (512*b*, 612*b*, 712*b*, 912*b*, 1012*b*) attached to the substrate, and has a diaphragm plate (717) disposed at a rear end of an optical path of the fluorescent sheet (112) and attached to the fluorescent sheet (112), the diaphragm plate (717) having a light-transmitting zone (717*a*) and a light-shading zone (717*b*) closely adjacent to each other. The diaphragm plate (717) can at least partially block light around a light-emission spot.

15 Claims, 10 Drawing Sheets

(51) Int. Cl.

| | |
|---|---|
| ***F21V 13/14*** | (2006.01) |
| ***F21V 7/00*** | (2006.01) |
| *F21Y 115/30* | (2016.01) |

(56) References Cited

U.S. PATENT DOCUMENTS

| | | | | |
|---|---|---|---|---|
| 2015/0175054 | A1* | 6/2015 | Yatsuda | F21S 41/255<br>362/465 |
| 2016/0004147 | A1* | 1/2016 | Hu | G02B 26/008<br>362/84 |
| 2016/0109074 | A1* | 4/2016 | Hirasawa | F21S 41/16<br>362/511 |
| 2016/0290583 | A1* | 10/2016 | Suwa | F21S 41/43 |
| 2017/0108190 | A1* | 4/2017 | Hadrath | F21S 41/14 |
| 2017/0305330 | A1* | 10/2017 | Park | F21S 41/255 |
| 2018/0224080 | A1* | 8/2018 | Reisinger | F21S 41/176 |

FOREIGN PATENT DOCUMENTS

| | | | |
|---|---|---|---|
| CN | 106449617 | A | 2/2017 |
| CN | 106773484 | A | 5/2017 |
| CN | 106838754 | A | 6/2017 |
| CN | 107166179 | A | 9/2017 |
| CN | 207145988 | U | 3/2018 |

* cited by examiner

LAMP

TECHNICAL FIELD

The invention relates to the field of lighting, in particular to the field of decorative lighting.

BACKGROUND

The lamps belong to the traditional field, and there are many kinds of lamps. After the emergence of LEDs, kinds of LED-based lamps are also emerging. However, with the improvement of people's living standards, there is an increasing demand for lighting, especially decorative lighting, and this demand has not yet been fully met.

SUMMARY

The invention provides a lamp, which includes a light source. The light source includes a laser diode and a wavelength conversion plate. The laser light emitted by the laser diode is focused on the wavelength conversion plate and excites the wavelength conversion plate to emit converted light. The wavelength conversion plate includes a transparent thermally conductive substrate and a wavelength conversion coating attached to the surface of the substrate. The laser emitted by the laser diode passes through the transparent thermally conductive substrate and is focused on the wavelength conversion coating. The surface of the transparent thermally conductive substrate is coated with an optical film that transmits laser light and at least partially reflects converted light. The position of the light spot is called the excitation area, and the area outside the excitation area is called the non-excitation area. It also includes a diaphragm placed after and close to the wavelength conversion plate along the optical path. The diaphragm includes light transmitting region and light blocking region, which are closely adjacent to each other. The light transmitting region is aligned to the excitation area of the wavelength conversion plate, and at least one point on the edge of the light transmitting region has a distance from the center of the excitation area smaller than the characteristic distance, and the characteristic distance L equals to $L=2d\mathrm{tg}\theta$, where $\theta=\arcsin(1/n)$, d and n are the thickness and refractive index of the transparent thermally conductive substrate respectively. The lamp also includes a light collimation element for receiving and collimating light emitted from the diaphragm.

The laser light emitting diode and the wavelength conversion plate could be used to realize a small light spot, so that a highly collimated light beam could be achieved after being collimated by a light collimation element. The diaphragm could at least partially block the diffused light ring around the light spot, in order to obtain a better decorative effect of the lamp.

BRIEF DESCRIPTION OF DRAWINGS

In order to more clearly illustrate technical solutions in embodiments of the present disclosure or in the related art, the accompanying drawings used in the embodiments and in the related art are briefly introduced as follows. Obviously, the drawings described as follows are merely part of the embodiments of the present disclosure, and other drawings could also be acquired by those skilled in the art without paying creative efforts.

DESCRIPTION OF EMBODIMENTS

Figure 1:
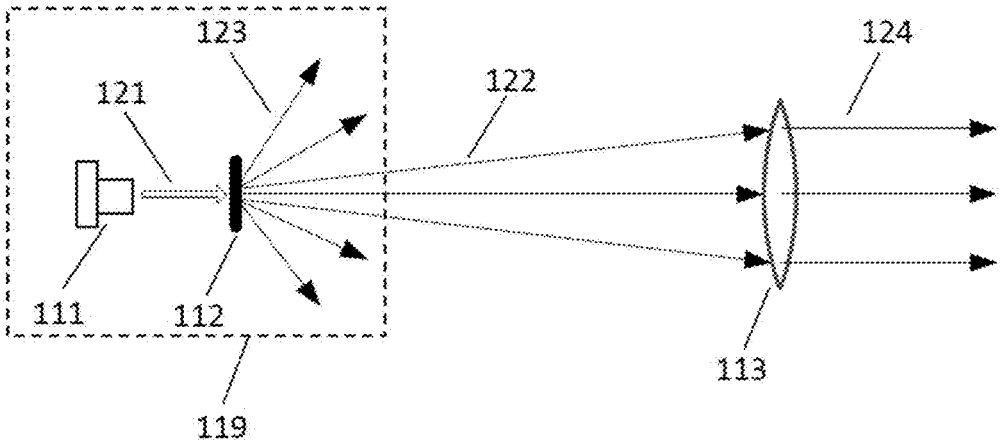
FIG. 1 is a schematic structural diagram of a lamp according to a first embodiment of the present invention.

The present invention provides a lamp, the structure diagram of which is shown in FIG. 1. The lamp includes a light source 119 and a light collimation element 113, wherein the light source 119 includes a laser diode 111 and a wavelength conversion plate 112. The laser light 121 emitted by the laser diode 111 focuses on the wavelength conversion plate 112 and excites the wavelength conversion plate to emit converted light 122 and 123. The light collimation element 113 is used for receiving light from the light source 119 and collimating it to form a collimated light 124 for emission. The full angle of the effective aperture of the light collimation element relative to the light emitting point is A, and A is not greater than 60 degrees. That is to say, the light collimation element 113 only collects the light (such as the light 122) emitted by the light source 119 within an angle of 30 degrees to the optical axis, but does not receive the light (such as the light 123) with emitting angle greater than 30 degrees to the optical axis. This part of light with emitting angle greater than 30 degrees is wasted. For a Lambertian light source (uniform light source), the energy of the light emitted within an angle of 30 degrees to the optical axis accounts for only 25% of the total energy. For the lamp of the present invention, the light collection efficiency of the light collimation element 113 is very low. In the art, low light collection efficiency means low output light energy and poor lighting effect, so such low collection efficiency is not a conventional design in the art. However, the present invention is designed in this way because the inventors found through experiments that the smaller the full angle of the effective diameter of the light collection element to the light emitting point, the more collimated the light beam passing through the light collection element, and at the same time the central light intensity is not reduced. In other words, the light lost by reducing the full angle of the light collimation element to the light emitting point, is the light with a larger emitting angle after passing through the light collimation element, so that the light intensity at the center has not decreased. This is obviously not the same conclusion with traditional optical theory, because the optical theory says that as long as the light source is placed at the focal point of the lens, the light could be collimated regardless of the angle, so reducing the collection angle will also reduce the central light intensity.

The inventors did not have a good theoretical explanation for the above experiments, but in practice it was found that collecting only the central light energy of the light source does not reduce the center light intensity, and the divergence angle of the collimated beam could be made smaller.

Classical optical theory tells us that the collimation degree of collimated light in a light collimation system is inversely proportional to the size of the light spot, that means the larger the light spot, the lower the degree of collimation. In the present invention, the laser light emitted by the laser diode is focused on the wavelength conversion plate. Since the laser light is coherent light emitted from a small light emitting chip, a very small light emitting spot could be formed on the wavelength conversion plate, so that a highly collimated light beam could be formed according to optical theory. At the same time, using the above mentioned experimental conclusion discovered by the inventors, controlling the full angle of the light collimation element to the light emitting point to a angle less than 60 degrees, could further improve the collimation degree of the collimated beam. In this way, a highly collimated outgoing beam could be obtained, which will not significantly spread at a distance a few meters or even tens of meters away. Such beams have many uses in decorative lighting.

Preferably, the full angle of the light collimation element to the light emitting point of the light source is less than 30 degrees, so that the collimation degree of the light beam could be further improved.

Figure 2:
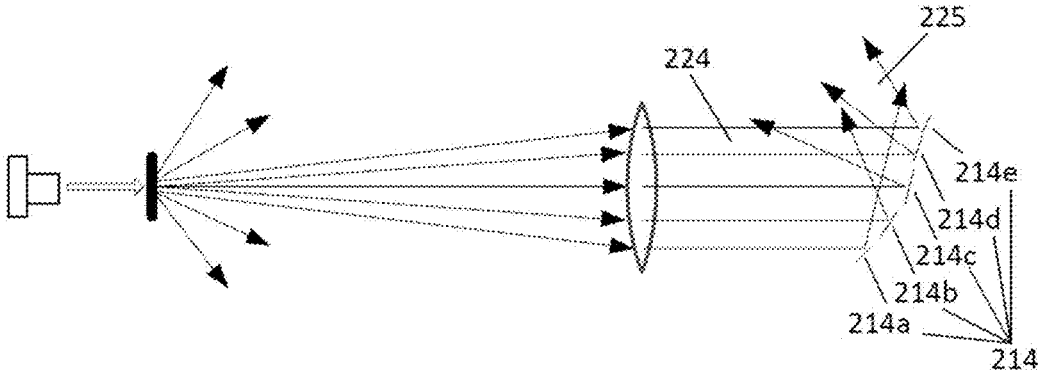
FIG. 2 is a schematic structural diagram of a lamp according to another embodiment of the present invention.

The embodiment shown in FIG. 2 takes an example of an application in lighting device. In the lamp of this embodiment, an curved-surface mirror array 214 located after the light collimation element along the optical path is also included, which including a plurality of plane mirrors 214*a*-214*e*, and the plurality of plane mirrors are arranged in an array along a curved surface. The collimated light beam 224 emitted from the light collimation element is incident on the curved mirror array 214, each of the plane mirrors 214*a*, 214*b*, 214*c*, 214*d*, and 214*e* receives a small portion of the light and reflects it to form multiple sub-beams, each sub-beam 225 is also a collimated light beam. Because multiple plane mirrors are arranged along an curved surface, the normal direction of each mirror slightly changes, so that the directions of multiple sub-beams reflected by them are also different. Because the collimated beam 224 is highly collimated, and the plane mirrors do not change the collimation of the light, so each sub-beam is also highly collimated. In this way, a plurality of highly collimated sub-beams will form a plurality of small light spots at a distance (for example, a few meters away from the lamp), thereby achieving the decorative lighting effect of "stars in the sky". In this embodiment, the key to the decorative effect of the "stars in the sky" is that each light spot is small and bright enough, which requires the collimation degree of the beam 224 to be sufficiently high and the central light intensity to be sufficiently large. It is precisely for the above mentioned reasons that the collimated beam generated by the embodiment shown in FIG. 1 of the present invention has the characteristics of high collimation and strong central intensity.

Figure 3:
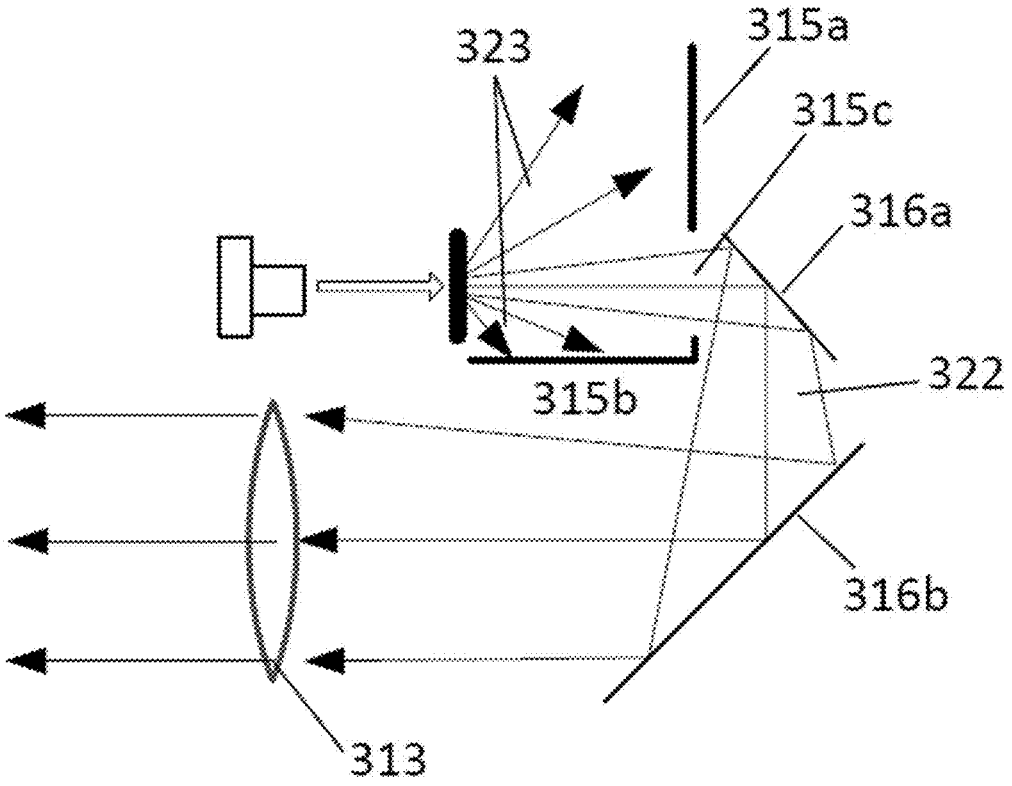
FIG. 3 is a schematic structural diagram of a lamp according to another embodiment of the present invention.

The previous embodiment has a problem that the light path from the light source to the light collimation element is very long, which is determined by the small full angle of the light collimation element to the light emitting point of the light source. The length of this light path is approximately equal to the effective aperture of the collimating element divided by the full angle (radian). The smaller the full angle, the longer this light path. This makes the entire system long and inconvenient in applications. This problem is solved in the embodiment shown in FIG. 3. Different from the embodiment shown in FIG. 1, this embodiment further includes two mirrors 316 *a* and 316 *b*. The light 322 emitted from the light source is reflected respectively by the reflection mirrors 316*a* and 316*b*, and then incident on the light collimation element 313. In this way, the optical path could be effectively prevented from being too long in one direction. But after the reflections of the mirrors, the overall optical path appears approximately equal length in both directions. In this embodiment, two mirrors are used. In fact, one or three or more mirrors could be used to reduce the optical path length.

Another difference between this embodiment and the embodiment shown in FIG. 1 is that it further includes diaphragms 315*a* and 315*b* located between the light source and the light collimation element 313 along the optical path. The diaphragm includes a light transmitting aperture 315*c*. Part of the light energy passes through the aperture 315*c* of the diaphragm, and this part of the light completely covers the effective aperture of the light collimation element. The remaining light 323 emitted by the light source is blocked by the diaphragm. This could reduce the ineffective light 323 into stray light and affect the decorative effect of the output light.

In the above embodiments, the light collimation elements are all a lens, and a part of the light emitted by the light source is incident on the lens and collimated after being refracted. The lens may be spherical lens or aspheric lens, preferably an aspheric lens in order to achieve better collimation. Since the refractive index of a transparent material varies with the wavelength of light, the light emitted by the light source will undergo dispersion after being refracted by the lens. In another embodiment, the light collimation element could also reflect the incident light to form collimated light in a reflective manner, as shown in FIG. 4.

Figure 4:
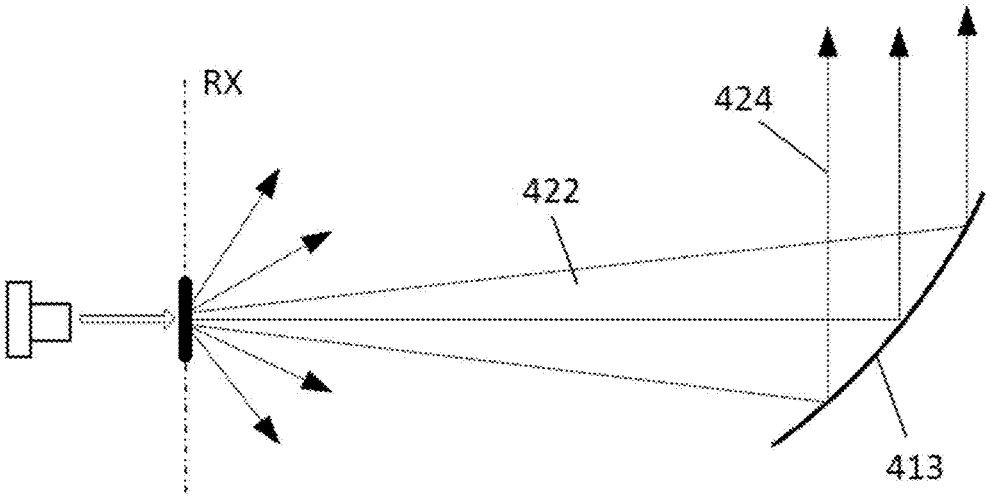
FIG. 4 is a schematic structural diagram of a lamp according to another embodiment of the present invention.

In the embodiment shown in FIG. 4, the light collimation element 413 is an curved reflector, and the light 422 emitted from the light source is incident and reflected by the light collimating light 424 to exit. Specifically, the cross section of the curved reflector on the plane of the paper surface in FIG. 4 is a section of a parabola, and the parabola is focused on the light emitting point of the light source. The cross section of the curved reflector on the plane which is perpendicular to the plane of the paper in FIG. 4 and parallel to the axis of incident light is a section of a circle, and the circle is centered on the light emitting point of the light source. It could also be understood that a segment of the parabola with the light emitting point as the focal point is rotated for some degree with the axis RX which passes through the light emitting point and is perpendicular to the light emitting light axis as the symmetry axis to obtain the curved reflector.

Unlike using a lens, the curved reflector does not have chromatic aberrations due to the refraction of light, so the color uniformity of the outgoing light is better. It could be understood that, in addition to the lens and the curved reflector, other light collimation elements could also be used in the present invention.

In the foregoing embodiments, the laser is focused on the wavelength conversion plate and excites the wavelength conversion plate to generate converted light, and the converted light is emitted isotropic in all directions, so about half of the light energy is emitted toward the light source, causing light loss. The embodiments from FIG. 5 to FIG. 10 are further optimized and explained with respect to the structure of the light source and the wavelength conversion plate.

Figure 5A:
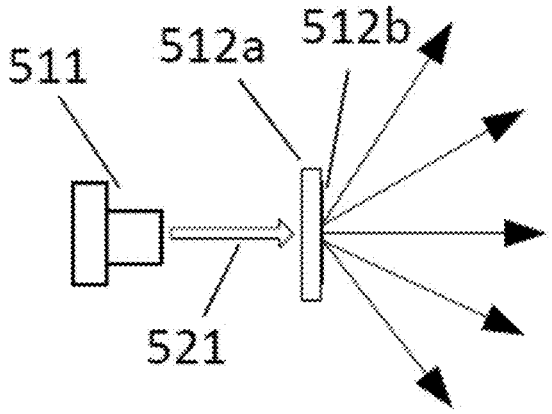
FIG. 5*a* shows a schematic structural diagram of a light source in a lamp according to another embodiment of the present invention.

In the embodiment shown in FIG. 5*a*, the wavelength conversion plate includes a transparent thermally conductive substrate 512*a* and a wavelength conversion coating 512*b* attached to the surface of the substrate 512*a*. The laser light 521 emitted by the laser diode 511 passes through the transparent thermally conductive substrate 512*a* and focuses on the wavelength conversion coating 512*b*. The transparent thermally conductive substrate could be made of a transparent thermally conductive material such as sapphire, diamond, or silicon carbide, which could help the wavelength conversion coating dissipate heat. The surface of the transparent thermally conductive substrate is coated with an optical film that transmits laser light and at least partially reflects converted light. In this way, at least part of the converted light excited by the laser diode could be reflected by the optical film and emitted toward the light collimation element, thereby effectively improving the light emission of the light source. Preferably, the optical film is coated on the surface of the transparent thermally conductive substrate 512*a* facing the wavelength conversion coating, which means the optical film is located between the transparent thermally conductive substrate and the wavelength conversion coating. In this way, the light emitted by the wavelength conversion coating could be directly reflected by the optical film without passing through the transparent thermally conductive substrate, reducing the lateral spread of the light.

Figure 5B:
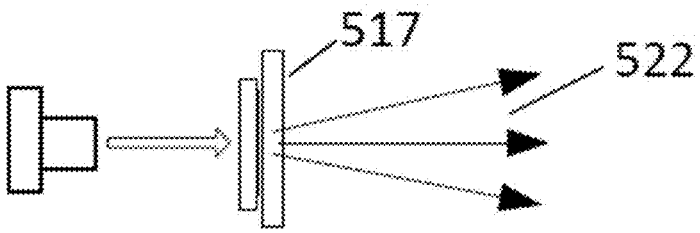
FIG. 5*b* shows a schematic structural diagram of a light source in a lamp according to another embodiment of the present invention.

In the embodiment shown in FIG. 5*b*, it is more preferable to further include a filter 517 positioned close to the wavelength conversion plate after the wavelength conversion plate along the optical path, for transmitting converted light having a light emission half-angle less than or equal to A/2 and at least partially reflecting the converted light with half-angle greater than A/2. As mentioned above, since the light collimation element could only receive converted light emitted by the light source at a half-angle of less than or equal to A/2, this part of the effective light will directly pass through the filter 517, and the remaining invalid light will be reflected back to the wavelength conversion plate. This part of the light will be emitted again after being scattered and reflected by the wavelength conversion plate, and some of it will change direction due to the scattering effect and be emitted within the range of emission half-angle less than or equal to A/2, and the rest of the light will be reflected back to the converted light by the filter 517 again. In other words, the original ineffective light is partially reused as the effective light after being reflected by the filter 517 and scattered by the wavelength conversion plate, thereby increasing the energy of the light source that could be incident on the light collimation element, which also improves the system efficiency.

Figure 6A:
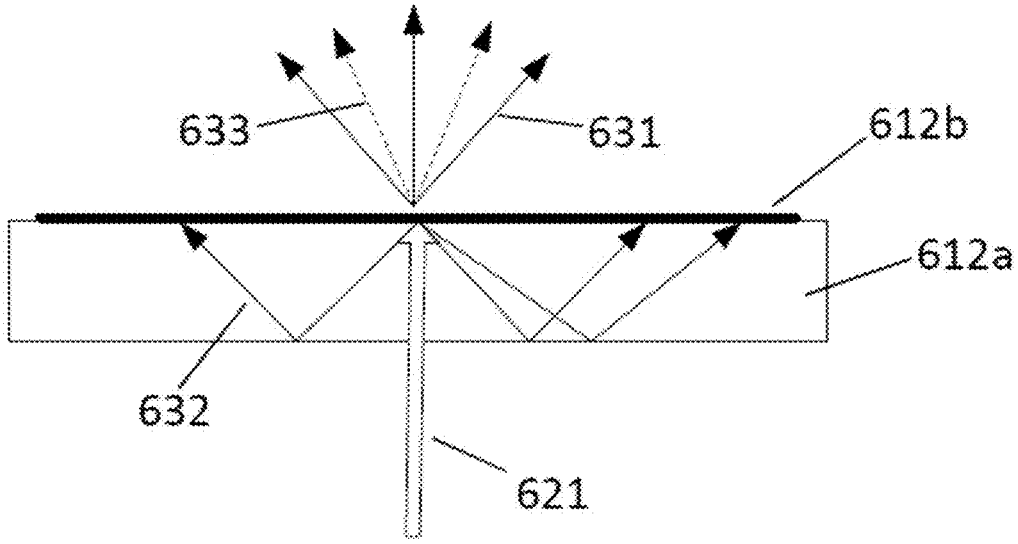
FIG. 6*a* shows an optical path for the diffusion of fluorescence in a transparent thermally conductive substrate in the embodiment shown in FIG. 5*a;*
Figure 6B:
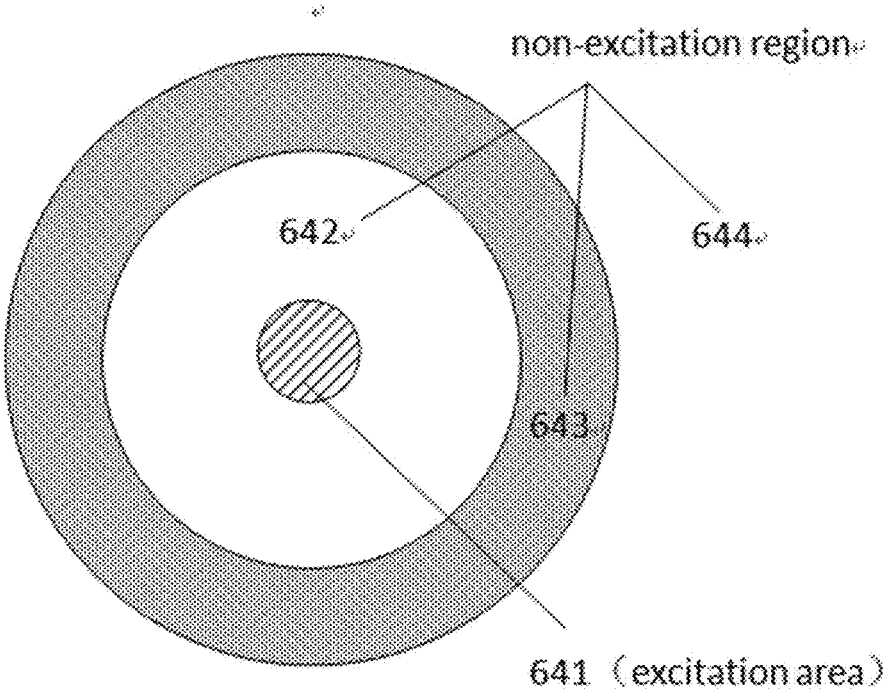
FIG. 6*b* shows a front view of the fluorescent coating in the embodiment shown in FIG. 5*a;*

In the embodiment shown in FIGS. 5*a* and 5*b*, there is a problem that light is lateral spread along in a transparent thermally conductive substrate, as shown in FIG. 6*a*. The laser light 621 passes through the transparent thermally conductive substrate 612*a* and is focused on the wavelength conversion coating 612*b* and excites it to emit converted light. In FIG. 6*a*, the converted light 631 and 632 are indicated by solid arrows, and the remaining laser light 633 not absorbed by the wavelength conversion coating is indicated by dotted arrows. Even if the optical film described in the embodiment of FIG. 5*a* exists, the optical film could not completely block the converted light, so besides the directly out put converted light 631, a part of the converted light 632 still enters the transparent thermally conductive substrate. This part converted light 632 with a larger incident angle will be totally reflected on the other opposite surface of the transparent thermally conductive substrate 612*a*, and return to the surface where the wavelength conversion coating is located, and at least partially exit. In this way, a light energy distribution as shown in FIG. 6*b* is formed on the surface of the wavelength conversion coating. FIG. 6*b* is a front view of the wavelength conversion plate when viewed facing the output direction of light emission. The spot where the laser focuses and incident on the wavelength conversion coating corresponds to the central spot 641 where the brightness is largest and most of the light exits directly from. This area is called the excitation area in the present invention, which means the area where the laser directly excites the converted light. The area outside the excitation area is called the non-excitation area, which is the area that is not directly excited by the laser to emit light. In the non-excitation area, the lateral spread converted light 632 entering the transparent thermally conductive substrate shown in FIG. 6*a* will form a diffused light ring 643 at the periphery on a distance away from the central light spot 641. There is a dark ring 642 exists between the central light spot 641 and the diffused light ring 643 and there is a dark region 644 exists outside the diffused light ring 643. It could be seen that the non-excitation area includes at least two regions, a region of dark ring 642 surrounding the excitation area 641 and adjacent to the excitation area, and a peripheral region not adjacent to the excitation area. The position of the boundary of these two areas—that is, the inner circle of the diffused light ring 643—is easy to be calculated. According to geometric optics, this corresponds to the incident position of the converted light that could be totally reflected on the lower surface of the transparent thermally conductive substrate. Minimum incident angle of total reflected converted light $\theta$ determined by $\theta=\arcsin(1/n)$, Where n is the refractive index of the transparent thermally conductive substrate. For example, for a transparent thermally conductive substrate made of sapphire, n=1.765, it could be calculated that $\theta=34.5$ degree. Referring to FIG. 6*a*, converted light with an incident angle of $\theta$ is reflected once in a transparent thermally conductive substrate with a propagation distance of L, and L=2dtgθ, where d is the thickness of the transparent thermally conductive substrate. For the convenience of description later, define L as the characteristic distance. The distance from the boundary of the dark ring 642 and the diffused light ring 643 to the center of the excitation area is the characteristic distance. The characteristic distance is related to the material and thickness of the transparent thermally conductive substrate. For example, for a transparent thermally conductive substrate made of sapphire with a thickness of 0.3 mm, the characteristic distance is equal to 0.41 mm.

It could be understood that the central spot (excitation area) 641 is the main player for lighting or decorative lighting, and the diffused light ring 643 as stray light will have a destructive effect on this lighting or decorative lighting, so the diffused light ring 643 should be reduced. To achieve this, at least two technical means could be used. They are illustrated in the following examples.

Figure 7A:
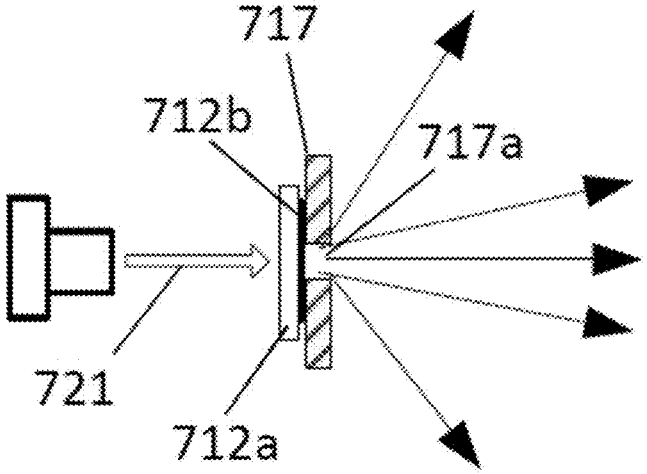
FIG. 7*a* shows a schematic structural diagram of a light source in a lamp according to another embodiment of the present invention.

The lamp of the embodiment shown in FIG. 7*a* further includes an diaphragm 717 placed after and close to the wavelength conversion plate along the optical path. The diaphragm 717 includes a light transmitting region 717*a* and a light blocking region, which are closely adjacent to each other. The light transmitting region 717*a* is aligned to the point on the wavelength conversion plate on which the laser light focused. In this embodiment, the laser 721 is transmitted through the transparent thermally conductive substrate 712*a* and focused on the wavelength conversion coating 712*b*, while the diaphragm 717 is placed next to the wavelength conversion coating 712*b* and its light transmitting region 717*a* is aligned to the point on the wavelength conversion coating on which the laser light focused. At least one point on the edge of the light transmitting region has a distance from the center of the excitation area smaller than the characteristic distance L. In this way, the effective light emitted from the excitation area could at least partially pass through the light transmitting region 717*a* and finally achieve the purpose of decorative lighting. At the same time, the diffused light ring is at least partially outside the light transmitting region so that the stray light is reduced. Preferably, the diffused light ring is all outside the light transmitting region of the diaphragm. At this time, the distance from all points on the edge of the light transmitting region to the center of the excitation area of the wavelength conversion plate is less than the characteristic distance L, so that all the light emitted by the diffused light ring will be blocked, so that the diffused light ring does not affect decorative lighting effects.

Figure 7B:
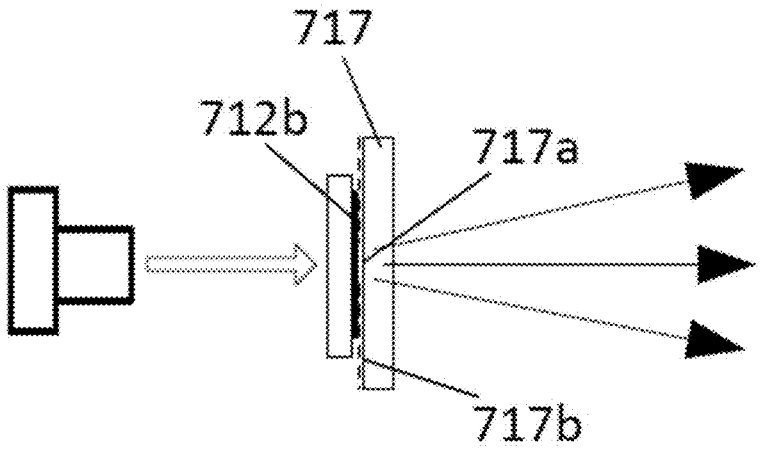
FIG. 7*b* is a schematic structural diagram of a light source in a lamp according to another embodiment of the present invention.

In the embodiment shown in FIG. 7*a*, the diaphragm 717 uses an opaque sheet to punch holes to achieve the light transmitting region 717*a*. This is a manufacturing method of the diaphragm. The limitation of this method is that it is difficult to make the hole with a very small diameter. More preferably, as shown in FIG. 7*b*, the diaphragm 717 is made of a transparent material, wherein the light blocking region 717*b* is formed by a light blocking coating film that absorbs or reflects incident light. There are many choices of transparent materials used to make the diaphragm, such as glass, quartz, and sapphire. The light blocking region is coated with a light blocking coating, and the part without the coating is the light transmitting region 717*a*. There are many advantages. Firstly, it could be realized by using a semiconductor process. The size and shape of the light transmitting region are almost unlimited, and the cost is low. Secondly, the thickness of the light blocking coating is negligible, so it will not affect the transmission of light transmitted in the light transmitting region. The light blocking coating film could be coated with a metal reflective film or an absorption film, and could also be coated with a non-metallic film, which is a very mature process. Preferably, the side of the diaphragm coated with the light blocking coating film is close to the wavelength conversion coating 712*b*, so that there is no light propagation distance between these two elements, so that the area where the diaphragm blocks light is more accurate.

Preferably, the diaphragm is coated with a filter film, which is used to transmit converted light having a emission half-angle equal to or smaller than A/2 and at least partially reflect converted light having a emission half-angle greater than A/2, so that the invalid converted light having emission half-angle greater than A/2 could be reused and more light is incident into the effective aperture of the light collimation element. Of course, in this embodiment, the light collimation element could also be designed to collect light from a larger angle from the light source, which obviously does not affect the beneficial effects of the diaphragm in this embodiment.

In the aforementioned embodiment shown in FIG. 7*a* and FIG. 7*b*, there is no limitation on the minimum size of the light transmitting region. Generally, in order to achieve the purpose of maximizing the light emitted from the excitation area on the wavelength conversion plate, the light transmitting region of the diaphragm should obviously be larger than and completely cover the excitation area of the wavelength conversion plate while the light transmitting region is aligning to the excitation area of the wavelength conversion plate, to ensure that all the light emitted from the excitation area could be emitted from the light transmitting region. However, in other occasions of decorative lighting, considering that the light emitted from the light transmitting region of the diaphragm will form an image on the decorative lighting field, the shape of the light transmitting region could be circular, pentagram, cross star, heart shape, triangle shape, square shape, regular hexagon shape, or elliptical shape, and may be smaller than the excitation area of the wavelength conversion plate to achieve a better decorative effect. For example, in the case shown in FIG. 7*c*, the light transmitting region on the diaphragm 717 is a cross-shaped region 717*a*, and the remaining region are light blocking region 717*b*. The light transmitting region 717*a* is aligned to the excitation area 741 of the wavelength conversion coating. In this way, although a large part of the light emitted by the excitation area 741 is blocked by the light blocking region and could not be emitted, a bright cross-shaped star will be displayed in the final decorative lighting field, achieving a special decorative effect. In this embodiment, the light transmitting region 717*a* is not limited to the inside of the excitation area of the wavelength conversion coating, and the tops of the four corners of the cross star also extend beyond the excitation area 741 of the wavelength conversion coating to achieve darkening effect at corner tops. It could be seen from this example that both the light transmitting region and the excitation area of the wavelength conversion plate must be aligned to each other, but the size and specific positional relationship between the two are not fixed, and they must be designed and determined according to the actual decorative effect requirement. For example, the light transmitting region of the diaphragm could also be smaller than the excitation area of the wavelength conversion coating. At this time, it could be ensured that the light emitted from the light transmitting region is the brightest, and the edge of the output light spot would have a clear light-dark boundary.

Figure 7C:
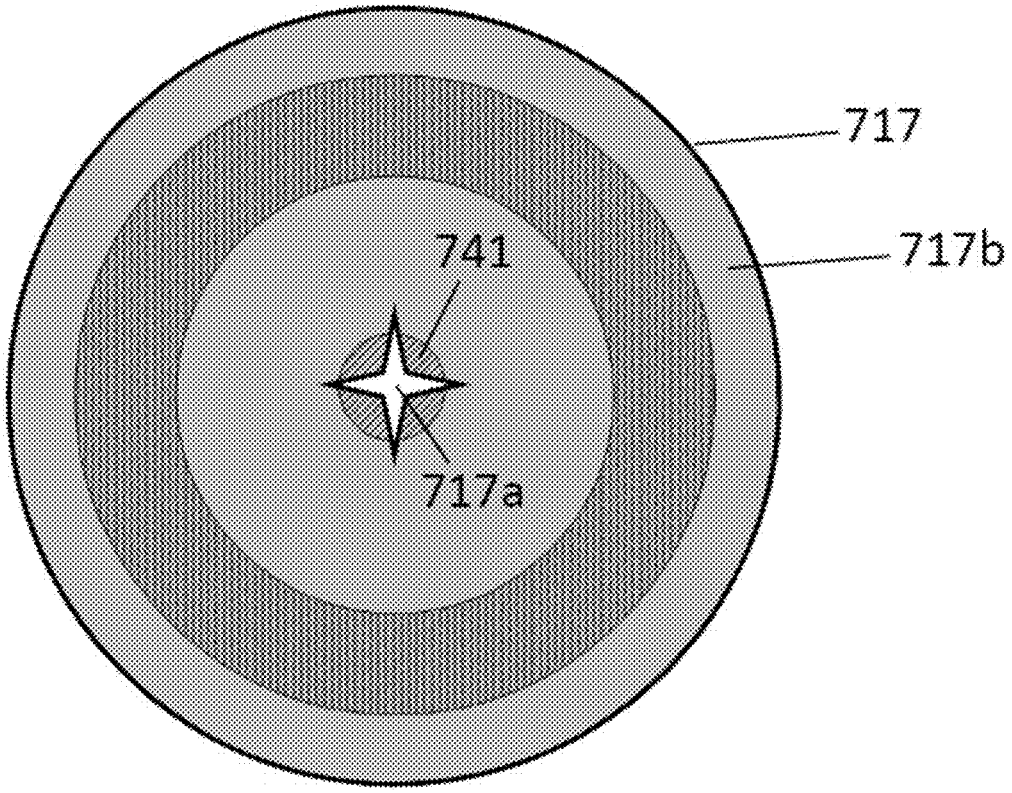
FIG. 7*c* shows a front view of a fluorescent coating and a diaphragm in a lamp according to another embodiment of the present invention.
Figure 8A:
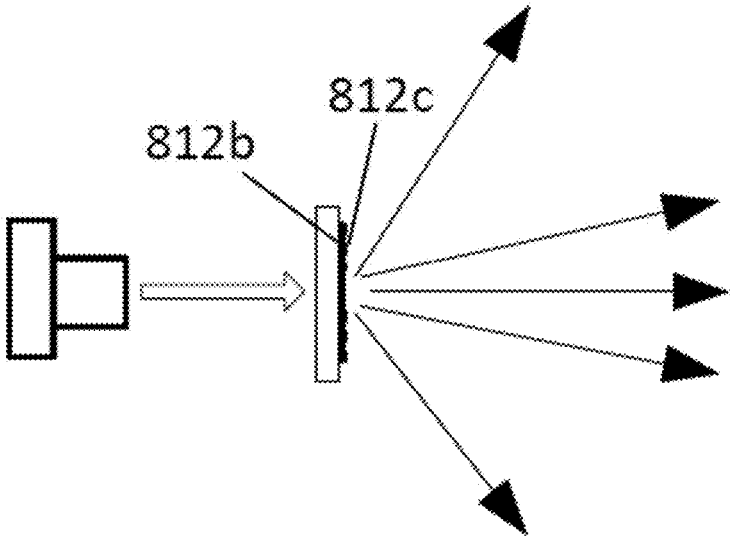
FIG. 8*a* shows a schematic structural diagram of a light source in a lamp according to another embodiment of the invention.
Figure 8B:
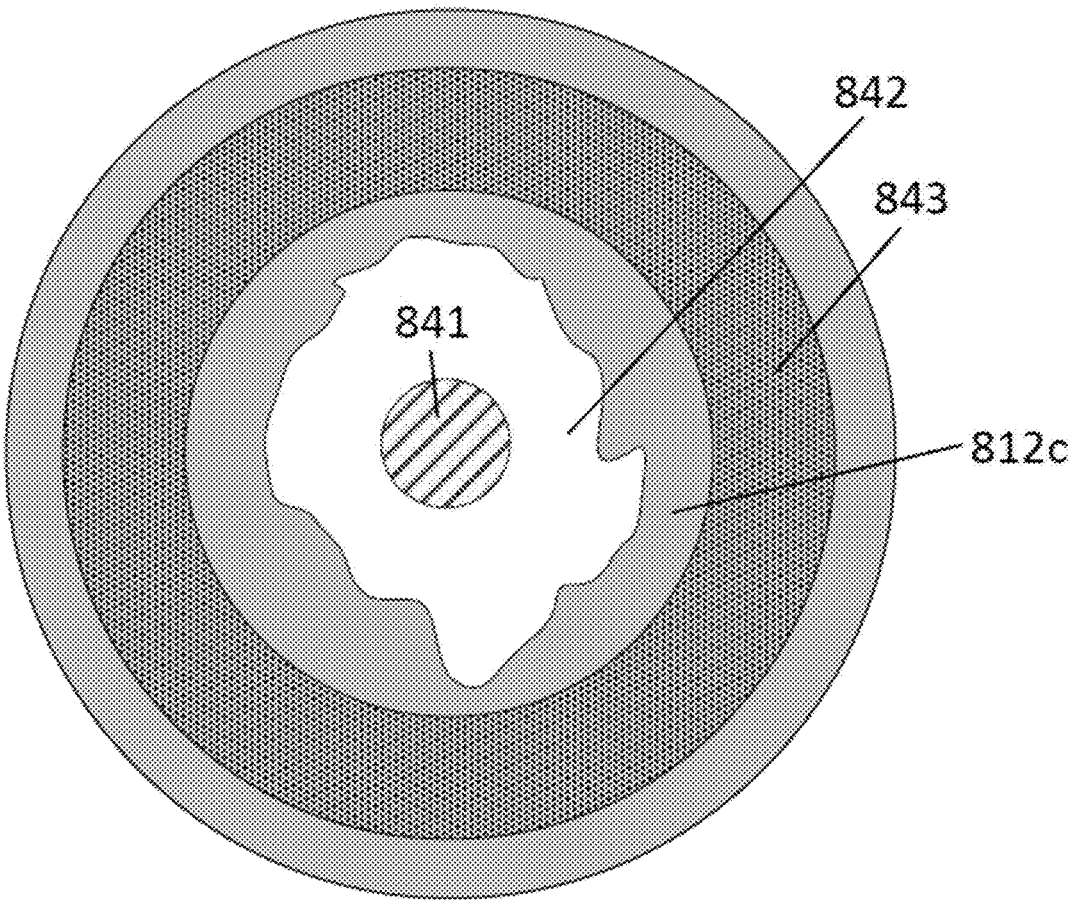
FIG. 8*b* shows a front view of a fluorescent coating in a lamp according to another embodiment of the present invention.

In the embodiment shown in FIG. 7*a* to FIG. 7*c*, one type of method for reducing diffused light ring is described, and another type of method is described below with the embodiment shown in FIGS. 8*a* and 8*b*. FIG. 8*a* is a schematic structural view of a light source in this embodiment, and FIG. 8*b* is a front view of a wavelength conversion coating facing the light emitting direction. In this embodiment, referring to FIG. 8*b*, a non-excitation area of the wavelength conversion coating 812*b* is at least partially coated with a light-absorbing paint 812*c*, and the portion coated with the light-absorbing paint includes at least one region, and the distance between the center of this region and the center of excitation area is equal to the characteristic distance L, then this area must at least partially cover the diffused light ring 643 so that the purpose of reducing the light emission of the diffused light ring is achieved. Preferably, the light-absorbing paint is an oil-based paint, which has the advantage that, for a hydrophilic wavelength conversion coating, the coating range of the oil-based paint is easy to control and does not spread to a large area in the wavelength conversion coating.

Obviously, in order to completely remove the influence of the diffused light ring, the portion of the wavelength conversion coating coated with the light-absorbing paint should completely cover the diffused light ring. In actual operation, the portion 812*c* coated with the light-absorbing paint should cover a region outside a circle region of the wavelength conversion coating, and the circle region has its center at the center of the excitation area and has radius of the characteristic distance L, that is, the area covering 843 region in FIG. 8*b* and its periphery.

For the dark ring adjacent to the excitation area, this part could be coated or not with light-absorbing paint, because this area also hardly emits light. Considering that the light-absorbing paint spreads in the wavelength conversion coating during the coating process, the dark ring could be used as a buffer zone for coating the light-absorbing paint. FIG. 8*b* is a front view of the wavelength conversion coating in this case. In this embodiment, the diffused light ring 843 around the dark ring 842 is completely covered by the light-absorbing paint, and the light-absorbing paint 812*c* will inevitably partially spread into the dark ring 842 (buffer zone). At the same time, due to the separation of the dark ring 842, the spread light-absorbing paint does not spread into the central excitation area 841. Therefore, the dark ring 842 will be divided into two parts, and one part far from the excitation area will be coated with light-absorbing paint, while the other part near the excitation area will not be coated with light-absorbing paint.

Preferably, in this embodiment, a filter (not shown in the figure) placed after and close to the wavelength conversion plate along the optical path, which is used to transmit converted light having a emission half-angle equal to or smaller than A/2 and at least partially reflect converted light having a emission half-angle greater than A/2, so that the invalid converted light having emission half-angle greater than A/2 could be reused and more light is incident into the effective aperture of the light collimation element. Of course, in this embodiment, the light collimation element could also be designed to collect light from a larger angle from the light source, which obviously does not affect the beneficial effects of the light-absorbing paint in this embodiment.

Figure 9A:
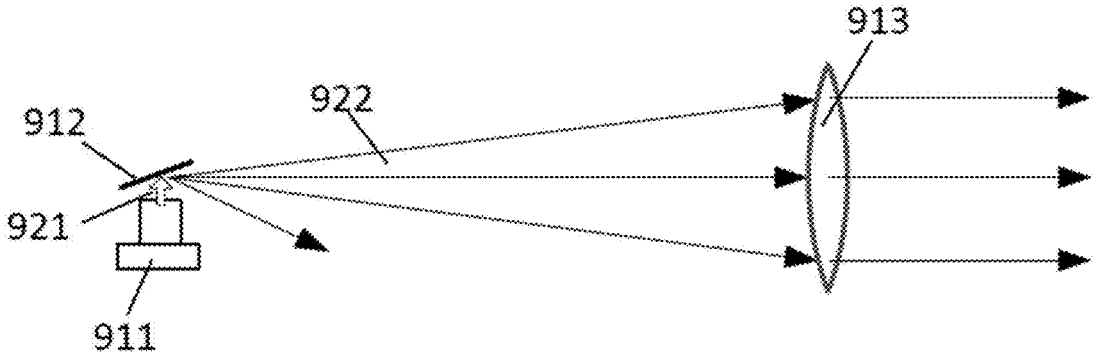
FIG. 9*a* is a schematic structural diagram of a lamp according to a first embodiment of the present invention.

In the above embodiments, the wavelength conversion plate is composed of a transparent thermally conductive substrate and a wavelength conversion coating layer coated on the surface. As described in FIG. 6*a* and the related description, in this case, there is a problem that part of the converted light lateral spread in the transparent thermally conductive substrate. Actually, there is another way to realize the wavelength conversion plate. The following embodiments illustrate this, and its structure diagram is shown in FIG. 9*a*.

Figure 9B:
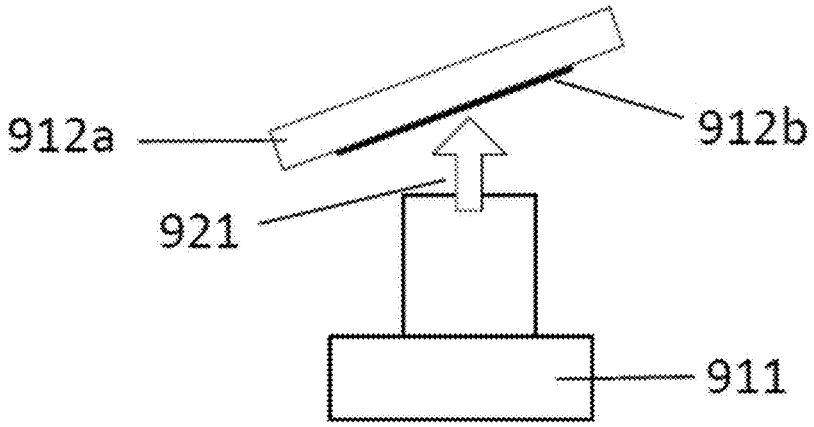
FIG. 9*b* is a schematic structural diagram of a light source in the lamp of the embodiment of FIG. 9*a;*

In the lamp of this embodiment, the wavelength conversion plate may emit converted light in a reflection form. The laser diode 911 emits a laser light 921 which is focused and incident on the wavelength conversion plate 912 and excites it to emit converted light. Specifically, the structure of the light source is shown in FIG. 9*b*. The wavelength conversion plate includes a reflective substrate 912*a* and a wavelength conversion coating 912*b* coated on the surface of the reflective substrate. The laser light 921 emitted from the laser diode 911 is incident on the wavelength conversion coating 912*b*. Due to the reflection effect of the substrate, the wavelength conversion coating could only emit converted light back to the direction of the reflective substrate. It could be understood that if the laser light 921 is vertically incident on the wavelength conversion coating 912*b*, the converted light is directed toward the laser diode, and a light output would be blocked by the laser diode. In this embodiment, the angle between the optical axis of the laser 921 and the normal plane of the wavelength conversion coating 912*b* is greater than A/2. At this time, a light beam 922 with a half angle greater than A/2 emits from the side face and could be collected and collimated by the light collimation device 913. In this method, there is no transparent light-guiding layer, so there is no lateral spread of converted light, and light could be more concentrated.

Figure 10A:
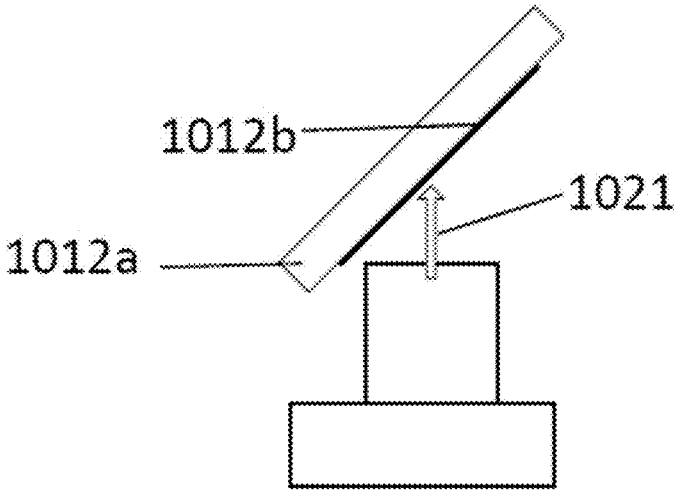
FIG. 10*a* is a schematic structural diagram of another light source in the lamp of the embodiment of FIG. 9*a;*
Figure 10B:
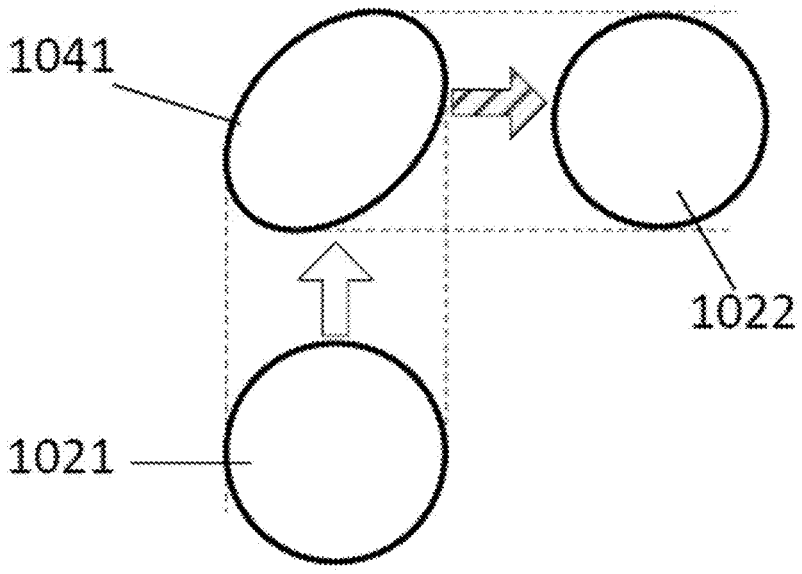
FIG. 10*b* shows the evolution of the light beam on both sides of the fluorescent sheet in the embodiment of FIG. 10*a;*

Preferably, the angle between the laser optical axis and the normal plane of the wavelength conversion coating is 45 degrees. As shown in FIG. 10*a*, the angle between the laser optical axis 1021 and the reflective substrate 1012*a* surface is 45 degrees. Referring to FIG. 10*b*, excitation light spot with circular cross section becomes an approximately elliptical spot and excites a converted light spot 1041 of the same shape, and the light collimation element receives the light emitted by the converted light spot 1041 from the direction of 45 degrees. Therefore, when looking at the receiving direction of the light collimation element, an approximately elliptical converted light emission spot will be re-projected into a circular converted light beam 1022, thereby finally forming a circular light spot. The circular light spot has a better device effect and is easier to be accepted by people.

Figure 11:
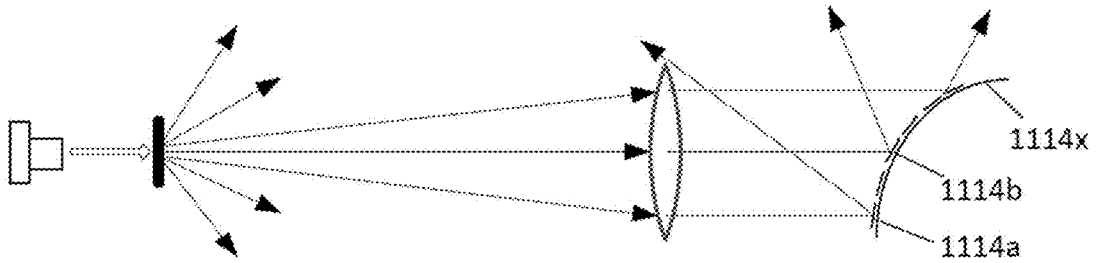
FIG. 11 is a schematic structural diagram of a lamp according to another embodiment of the present invention.

In the foregoing embodiments, several implementation forms of the light source and the light collimation device are exemplified. In the embodiment shown in FIG. 2, how to use such a light emitting device (including the light source and the light collimation device) with an mirror array on a curved surface is described to achieve the decorative lighting effect of "stars in the sky". In this embodiment, a plurality of plane mirrors are arranged along an irregular curved surface. In the embodiment shown in FIG. 11, the difference is that a plurality of planar mirrors 1114*a* and 1114*b* are distributed on a convex surface 1114*x*, and the normal direction of each planar mirrors is the same as that of the convex surface at this position. Obviously, the normal directions of each plane mirrors are different so that the directions of the multiple sub-beams formed by these plane mirrors are different.

Figure 12:
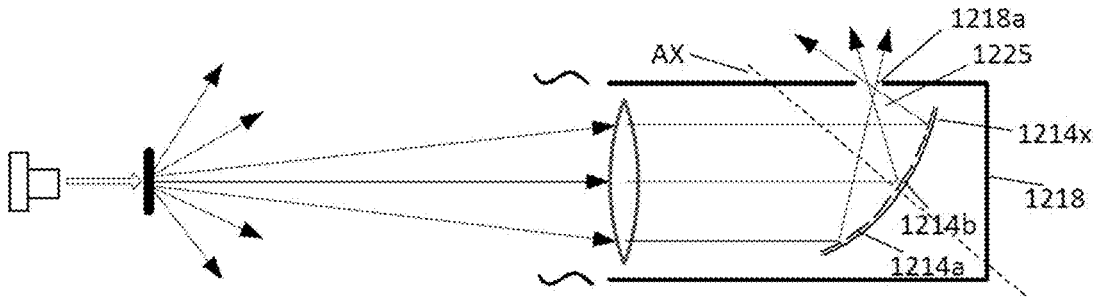
FIG. 12 is a schematic structural diagram of a lamp according to another embodiment of the present invention.

In the lamp of the embodiment shown in FIG. 12, the concave mirror array located after the light emitting device (including the light collimation element) along the light path includes a plurality of plane mirrors 1214*a* and 1214*b*, etc., and the plurality of plane mirrors are arranged in an array along a concave surface 1214*x*. The light emitted from the light emitting device is reflected by the mirror array on concave surface to form a plurality of collimated sub-beams 1225. Geometric optics tells us that any concave mirror could reflect a collimated beam into a converged beam, and in this embodiment, the normal direction of each plane mirror 1214*a* and 1214*b* is the same as the normal direction of the concave surface at this position. Therefore, the normal directions of plane mirrors 1214*a* and 1214*b* continuously change and the plurality of collimated sub-beams reflected by the plurality of plane mirrors 1214*a* and 1214*b* are converged. In the lamp of this embodiment, a housing 1218 is further included, and a mirror array on concave surface is located in the housing 1218. The surface of the housing 1218 includes a transmitting region 1218*a*, and a plurality of sub-beams are converged and transmitted through the transmitting region 1218*a*. Since the sub-beams are converged, the area where these sub-beams converge will obviously be smaller than the size of the concave mirror array, so the transmitting region on the housing could also be relatively small to allow all the sub-beams to pass through. In detail, the dimension of the transmitting region 1218*a* in one direction is smaller than the dimension of the concave mirror array in same direction. From the perspective of the product, a small transmitting region on the housing could give people the impression that all the sub-beams are emitted from one point, and it is not easy to see all the structures inside the housing 1218 from the transmitting region inward so that the appearance is good.

Preferably, the shape of the light-transmitting region 1218*a* on the surface of the housing is circumscribed with the envelope of the total light spot formed when multiple sub-beams pass through the transmitting region. It could also ensure that the area of the transmitting region is minimized. Preferably, the transmitting region on the surface of the housing is circular, pentagonal, drop-shaped, elliptical, square, rectangular, trapezoidal, heart-shaped, regular hexagon, or triangular to achieve a better appearance effect. In this embodiment, the concave surface 1214*x* is a spherical surface or an ellipsoidal surface. The concave surface 1214*x* may also have different curvatures in two mutually perpendicular dimensions to achieve different light point distributions after reflection.

Further, the lamp in this embodiment further includes a motor (not shown) for driving the curved-surface mirror array to rotate with respect to the normal direction AX of the center of the concave surface 1214*x*. With the rotation of the concave surface and each of the plane mirrors 1214*a* and 1214*b*, the sub-beams reflected by the concave mirror array will also rotate. Multiple rotating light spots are formed to achieve a good visual effect. Of course, the motor could also drive the curved-surface mirror array to perform other periodic motions to achieve other visual effects.

Obviously in this embodiment, the light emitting device does not necessarily adopt the structure of the light source and the light collimation element shown in FIG. 1. As long as the light emitting device could emit a collimated light beam, the beneficial effects of this embodiment could be achieved.

Figure 13:
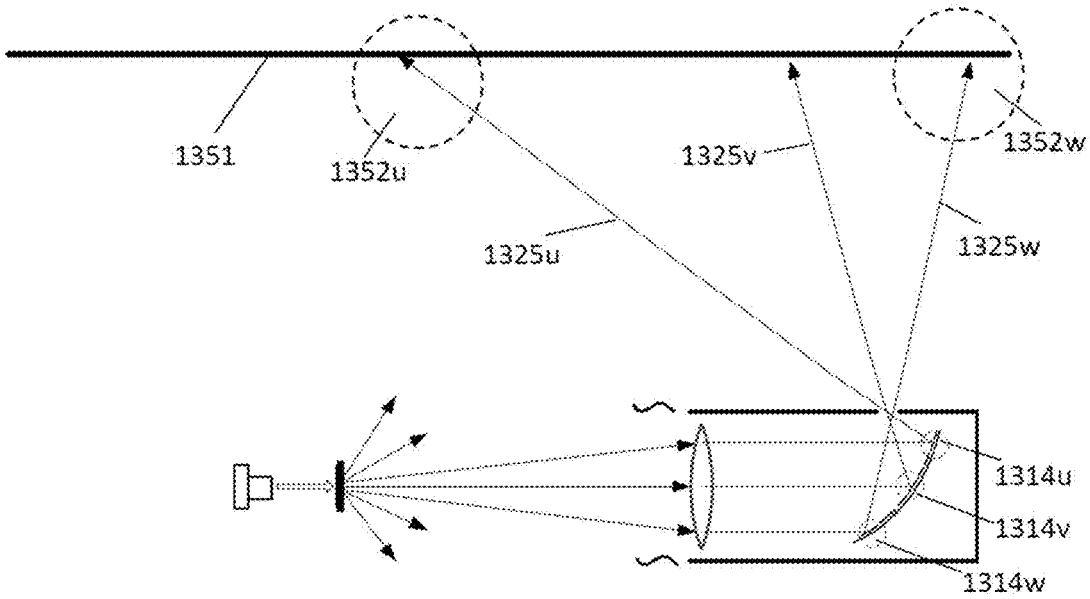
FIG. 13 is a schematic structural diagram of a lamp according to another embodiment of the present invention.

The embodiment shown in FIG. 13 is a further improvement of the embodiment of FIG. 12. In the lamp of this embodiment, the concave mirror array after the light emitting device along the light path includes a plurality of plane mirrors. The plurality of plane mirrors are arranged in an array along a concave surface. After reflection, multiple sub-beams 1325*u*, 1325*v*, and 1325*w* are formed, and the multiple sub-beams are irradiated on the target surface 1351 to form multiple sub-spots.

Obviously, the incident angle of the sub-beam 1325*u* incident on the target surface 1351 (the angle between the incident light and the normal of the target surface at the incident point) is greater than the incident angle of the sub-beam 1325*w* incident on the target surface 1351. Assume that the number of plane mirrors per unit area in the concave mirror array (that is, the density of the plane mirrors) is uniform. Due to the influence of the projection angle, The distance between the light spots formed by the sub-beam 1325*u* and its adjacent sub-beam on the target surface is necessarily greater than the distance between the light spots formed by the sub-beam 1325*w* and its adjacent sub-beam on the target surface 1351. In this way, the spot array formed on the target surface 1351 is non-uniform: the spot density of the region 1352*u* where the sub-beam 1325*u* is incident is smaller than the spot density of the region 1352*w* where the sub-beam 1325*w* is incident.

However, a uniform light spot density could achieve better visual effects. In order to achieve a more uniform light spot density, in this embodiment, it is considered that the area 1314*u* on the concave mirror array reflects incident light beam to form the sub-beam 1325*u*, and the area 1314*w* reflects incident light beam to form a sub-beam 1325*w*, and the number of plane mirrors per unit area of the 1314*u* area (density of the plane mirrors) is greater than the number of plane mirrors per unit area of the 1314*w* area, so that the difference in distance between adjacent light spots caused by the projection angle could be at least partially compensated. For the sub-beams 1325*v* and 1325*w*, the incident angles on the target surface 1351 are similar, so the density of the plane mirrors on the corresponding regions 1314*v* and 1314*w* could be set to be similar.

In summary, the concave mirror array includes dense area and sparse area. The number of plane mirrors per unit area in the dense area is greater than the number of plane mirrors per unit area in the sparse area. The average incident angle of the sub-beam of dense area incident on the target surface is greater than the average incident angle of the sub-beams of the sparse area incident on the target surface. Rely on a higher density of plane mirrors of dense area to compensate for the effect of larger spot distance caused by larger incident angle of the reflected sub-beams on the target surface, spots distance on the target surface becomes uniform. In this embodiment, the area 1314*u* on the concave mirror array is a dense area, and the area 1314*w* is a sparse area. In this embodiment, the dense area is located on an end of the concave surface near the light emission direction, and the sparse area is located on an end of the concave surface away from the light emission direction. It could be understood that there may be multiple pairs of dense and sparse areas on the concave mirror array.

In this embodiment, a concave mirror array is used as an example. Obviously, the settings of the dense area and the sparse area could also be applied to the convex mirror array (see the embodiment shown in FIG. 11) and other types of curved mirror arrays, and the mode of action and the rules are not related to the specific form of the curved surface.

Obviously, in this embodiment, the light emitting device does not necessarily adopt the structure of the light source and the light collimation element shown in FIG. 1, as long as the light emitting device could emit a collimated light beam, the beneficial effects of this embodiment could be achieved.

Figure 14:
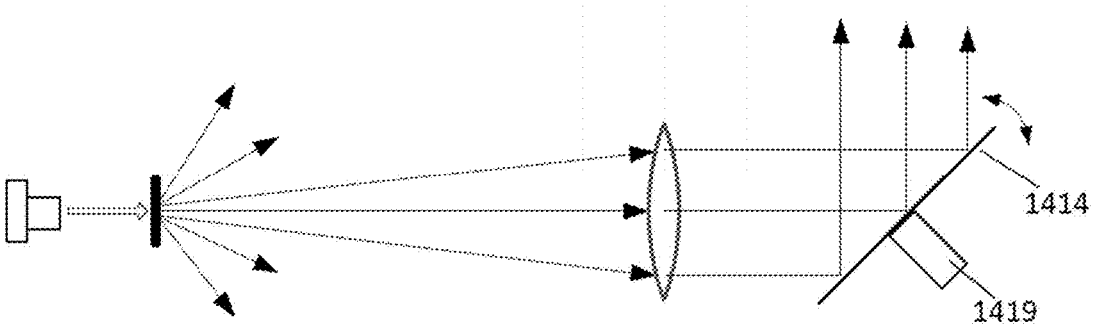
FIG. 14 is a schematic structural diagram of a lamp according to another embodiment of the present invention.

In addition to the curved mirror array described in the above embodiments, a lamp in the present invention may further include a reflection plate and a motor after the light emitting device (including the light source and the light collimation element) along the light path. The motor drives the reflection plate to rotate or periodically move. The schematic is shown in FIG. 14. The reflecting plate 1414 reflects the collimated light emitted by the light emitting device, and the motor drives the reflecting plate to rotate, so that a reflected light spot could be controlled to move in scanning mode to form the visual effect of the moving light spot. The motor could also drive the reflector to perform other periodic movements to form other light spot movement modes.

Figure 15:
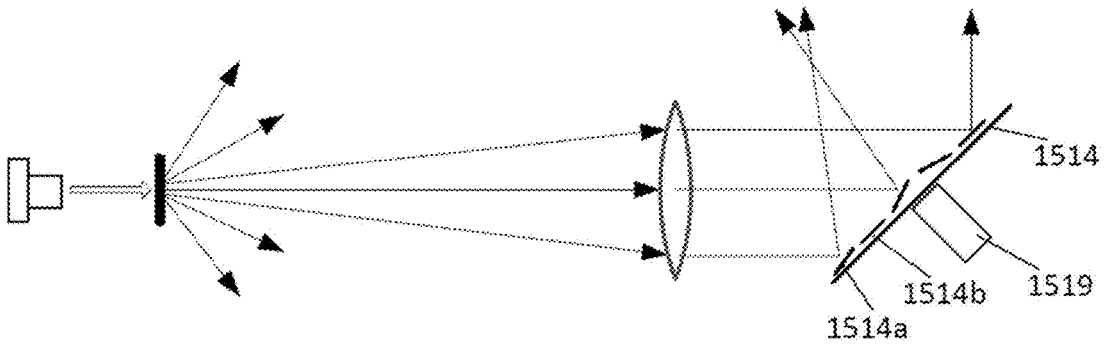
FIG. 15 is a schematic structural diagram of a lamp according to another embodiment of the present invention.

In the lamp of the embodiment shown in FIG. 15, a micro mirror array 1514 is included after the light emitting device that emits the collimated light beam along the light path. And the micro mirror array 1514 includes a plurality of micro mirrors 1514*a* and 1514*b* to reflect incident collimated light to form a plurality of sub-beams. The mirrors 1514*a* and 1514*b* in the mirror array could be independently controlled to flip, which corresponds to that the propagation directions of multiple sub-beams could be independently controlled. An array of light spots formed on the target surface (not shown) and each spot could be controlled and moved independently to form a unique visual effect. Further, the lamp in this embodiment further includes a motor 1519 for driving the mirror array to rotate or periodically move. In this way, the light spot array formed on the target surface could be rotated or moved periodically, and the independent control movement of each light spot could be performed simultaneously, forming a unique visual effect. Obviously, in this embodiment, the light emitting device does not necessarily adopt the structure of the light source and the light collimation element shown in FIG. 1, as long as the light emitting device could emit a collimated light beam, the beneficial effects of this embodiment could be achieved.

The above description is only for embodiments of the present invention, and thus does not limit the patent scope of the present invention. Any equivalent structure or equivalent process transformation made by using the description and drawings of the present invention, or directly or indirectly applied to other related technologies belongs to the fields of patent protection of the present invention.

What is claimed is:

1. A lamp characterized by comprising:

a light source includes laser diode and a wavelength conversion plate, laser light emitted by the laser diode is focused on the wavelength conversion plate and excites the wavelength conversion plate to form a excitation spot and emit converted light, and the excitation spot on the wavelength conversion plate is called excitation area, and area outside the excitation area on the wavelength conversion coating is called non-excitation area;

a diaphragm is located after and close to the wavelength conversion plate along the optical path, and the diaphragm includes light transmitting region and light blocking region which are closely adjacent to each other, and the light transmitting region is aligned to the excitation area of the wavelength conversion plate, and the distance from at least one point on the edge of the light transmitting region to the center of the excitation area is less than the characteristic distance, where the characteristic distance L is equal to $L=2d\mathrm{tg}\theta$, where $\theta=\arcsin(1/n)$, d and n are the thickness and refractive index of the wavelength conversion plate, respectively;

alight collimation element used for receiving and collimating light emitted from the diaphragm.

2. The lamp according to claim 1, further comprising: a mirror array on curved surface located after the light collimation element along the optical path, comprising a plurality of plane mirrors arranged in an array along the curved surface.

3. The lamp according to claim 2, further comprising a motor for driving the curved mirror array to rotate or periodically move.

4. The lamp according to claim 2, wherein the surface of the transparent thermally conductive substrate is coated with an optical film that transmits laser light and at least partially reflects converted light.

5. The lamp according to claim 1, wherein the light collimation element is a lens, used to collects and collimates a part of the light emitted by the light source.

6. The lamp according to claim 1, wherein the light blocking region is formed by a light blocking coating film coated on a transparent material, and the coating film absorbs or reflects incident light.

7. The lamp according to claim 6, wherein the coating side of the diaphragm is close to the wavelength conversion coating.

8. The lamp according to claim 1, wherein the full angle of the effective aperture of the light collimation element relative to the excitation spot is A; the diaphragm is coated with a filter film, which is used to transmit converted light with a light emission half angle less than or equal to A/2 and at least partially reflect converted light with a half-angle greater than A/2.

9. The lamp according to claim 1, where in the shape of the light transmitting region is circular, pentagram, cross star, heart, triangle, square, regular hexagon or ellipse.

10. The lamp according to claim 1, where in light transmitting region is smaller than the excitation area of the wavelength conversion coating.

11. The lamp according to claim 1, wherein the effective aperture of the light collimating element relative to the excitation spot is A, and A is not greater than 60 degrees.

12. The lamp according to claim 1, wherein the light collimation element is curved-surface-shaped reflecting plate, whose cross sections are a section of a circle and a section of a parabola respectively in two mutually orthogonal dimensions, and the circle is centered on the excitation spot of the light source, and the parabola focuses on the excitation spot of the light source.

13. The lamp according to claim 1, wherein the diaphragm is an opaque sheet with punched hole to form the light transmitting region.

14. The lamp according to claim 1, wherein the distance from all points on the edge of the light transmitting region to the center of the excitation area is less than the characteristic distance L.

15. The lamp according to claim 1, wherein the wavelength conversion plate includes a transparent thermally conductive substrate and a wavelength conversion coating attached to the surface of the substrate, and the laser light emitted by the laser diode passes through the transparent thermally conductive substrate and is focused on the wavelength conversion coating to form a light emitting spot.

* * * * *